United States Patent [19]

Reed et al.

[11] Patent Number: 4,874,487

[45] Date of Patent: Oct. 17, 1989

[54] CORROSION PROTECTION

[75] Inventors: James P. Reed, San Francisco; Michael Masia; Albert Highe, both of Redwood City, all of Calif.

[73] Assignee: Raychem Corporation, Menlo Park, Calif.

[21] Appl. No.: 142,153

[22] Filed: Jan. 11, 1988

Related U.S. Application Data

[63] Continuation of Ser. No. 888,198, Jul. 18, 1986, abandoned.

[51] Int. Cl.[4] ..... C23F 13/02

[52] U.S. Cl. ..... 204/147; 204/196

[58] Field of Search ..... 204/147, 148, 196, 197, 204/202

[56] References Cited

U.S. PATENT DOCUMENTS

| | | | |
|---|---|---|---|
| 2,244,322 | 6/1941 | Zoller et al. | 204/148 |
| 2,360,244 | 10/1944 | McAnneny | 204/196 |
| 2,595,042 | 4/1952 | Wyllie | 204/435 |
| 2,614,976 | 10/1952 | Patnode et al. | 204/419 |
| 2,870,077 | 1/1959 | Kushner | 204/435 |
| 3,022,242 | 2/1962 | Anderson | 204/196 |
| 3,135,677 | 6/1964 | Fischer | 204/196 |
| 3,461,051 | 8/1969 | Vrable | 204/196 |
| 3,471,394 | 10/1969 | Sudrabin | 204/435 |
| 3,515,654 | 6/1970 | Bordalen et al. | 204/196 |
| 3,616,354 | 10/1971 | Russell | 204/196 |
| 3,616,421 | 10/1971 | Mackintosh | 204/197 |
| 3,830,719 | 8/1974 | Cavil | 204/196 |
| 4,171,254 | 10/1979 | Koeneche | 204/197 |
| 4,318,787 | 3/1982 | Peterson et al. | 204/147 |
| 4,502,929 | 3/1985 | Stewart et al. | 204/147 |

FOREIGN PATENT DOCUMENTS

| | | |
|---|---|---|
| 936470 | 9/1963 | United Kingdom . |
| 1161625 | 8/1969 | United Kingdom . |
| 1270426 | 4/1972 | United Kingdom . |

*Primary Examiner*—T. Tung

*Attorney, Agent, or Firm*—Timothy H. P. Richardson; Herbert G. Burkard

[57] ABSTRACT

Corrosion protection systems which make use of a barrier which is placed between a corrodible substrate and a counter-electrode. The barrier can provide more uniform current distribution on the substrate, and/or enable the counter-electrode to be more easily maintained or replaced, and/or reduce the rate at which the current density on an elongate electrode changes with distance from the power source, and/or provide a controlled environment around the electrode to improve its efficiency.

19 Claims, 3 Drawing Sheets

CORROSION PROTECTION

This is a continuation of application Serial No. 888,198, filed July 18, 1986, now abandoned.

BACKGROUND OF THE INVENTION

1. Field of the Invention

This invention relates to the corrosion protection of pipes, vessels and other corrodible substrates.

2. Introduction to the Invention

It is well known to protect substrates from corrosion by establishing a corrosion-protecting potential difference between the substrate and a counter-electrode. In impressed current systems, which are generally preferred, a DC power source is used to establish (or help to establish) the desired potential difference, and the anode is preferably composed of a material which is resistant to corrosion, e.g. platinum, graphite, or a conductive polymer. Generally, the substrate is the cathode, but there are systems in which the substrate is the anode and the protection is provided by an oxide layer which is built up and maintained on the substrate. In sacrificial systems, the counter-electrode is an anode composed of a metal which is less noble than the substrate, and the desired potential difference is established automatically. Reference may be made for example to U.S. Pat. Nos. 4,502,929 (Steward et al), 4,473,450 (Nayak et al), 4,319,854 (Marzocchi), 4,255,241 (Kroon), 4,267,029 (Massarsky), 3,868,313 (Gay), 3,798,142 (Evans), 3,391,072 (Pearson), 3,354,063 (Shutt), 3,022,242 (Anderson), 2,053,314 (Brown) and 1,842,541 (Cumberland), U.K. Patents No. 1,394,292 and 2,046,789A, and Japanese Patents Nos. 35293/1973 and 48948/1978, as well as copending commonly assigned application Ser. No. 684,900 (Stratfull), the disclosures of which are incorporated herein by reference.

The known corrosion systems suffer from serious disadvantages in a number of commercially important situations. One disadvantage is a failure to obtain sufficiently uniform current distribution on the substrate. This disadvantage can arise from the use of one or more discrete electrodes; or from the use of a distributed electrode, e.g. a platinum wire, whose radial resistance to the substrate is low, so that at high currents the current density on the anode decreases rapidly as the distance from the power source increases; and/or because the substrate is shielded (including those situations in which the substrate has a complex shape which results in one part of the substrate being shielded by another part of the substrate). The flexible elongate anodes disclosed in U.S. Pat. Nos. 4,502,929 and 4,473,450, which comprise a low resistance core surrounded by a conductive polymer coating, are very useful in mitigating this disadvantage, but they cannot be used at the high current densities which are required in certain situations, for example the protection of structures which have no protective coating thereon. Another disadvantage is the relatively short life of anodes (including the electrical connections thereto), especially when exposed to environments which are highly corrosive or which contain oily contaminants, and in the case of platinum anodes, when exposed to fresh potable water, and the difficulty and expense of repairing or replacing the anodes when this becomes necessary.

SUMMARY OF THE INVENTION

I have now discovered that these disadvantages can be mitigated or overcome by means of a barrier which lies between the substrate and the counter-electrode, which is spaced part from the substrate and the counter-electrode, and which directs the flow of ions between the substrate and the counter-electrode, and thus provides an improved current distribution on the substrate, and/or enables the counter-electrode to be more easily maintained or replaced, and/or reduces the rate at which the current density on an elongate electrode changes with the distance from the power source, and/or provides a controlled environment around the electrode to improve its efficiency, e.g. by reducing contamination or by making it possible to surround the counter-electrode with an electrolyte which is different from the electrolyte which contacts the substrate.

In one aspect, the present invention provides an assembly for cathodically protecting an electrically conductive substrate from corrosion, the assembly comprising (1) an electrically conductive substrate which is liable to corrosion;

(2) an elongate distributed anode, i.e. an anode which has a shape corresponding generally to the shape of the substrate and which is relatively close to all points on the substrate; and (3) a barrier which (i) lies between the substrate and the anode, (ii) is spaced apart from the substrate and from the anode, and (iii) is in the form of a tube which surrounds the anode and has a plurality of ion-permeable sections therein such that, when the anode and the substrate are electrically connected to opposite poles of a DC power source and are electrically connected by means of an electrolyte, the barrier restricts the flow of current between the substrate and the anode so that the resistance between the substrate and the anode is Q times the resistance between them in the absence of the barrier, where Q is at least 1.5.

In another aspect, the present invention provides a method of cathodically protecting an electrically conductive substrate from corrosion by an electrolyte which contacts it, which method comprises establishing a potential difference between the substrate as cathode and an elongate distributed anode which has a shape corresponding generally to the shape of the substrate and which is relatively close to all points on the substrate, and in which method current flows between the substrate and the anode along current paths which pass through ion-permeable sections of a barrier which (i) lies between the substrate and the anode, (ii) is spaced apart from the substrate and the anode, and (iii) is in the form of a tube which surrounds the anode and has a plurality of ion-permeable sections therein.

In another aspect the invention provides a method of cathodically protecting an electrically conductive vessel from corrosion by a liquid electrolyte contained in the vessel, which method comprises establishing a potential difference between the vessel and a discrete anode which is located in an anode chamber which lies outside the vessel and which contains a liquid electrolyte, and driving electrolyte from the anode chamber into the vessel through a tube having at least one aperture within the vessel.

BRIEF DESCRIPTION OF THE DRAWING

The invention is illustrated in the accompanying drawing, in which.

DETAILED DESCRIPTION OF THE INVENTION

Figure 1:
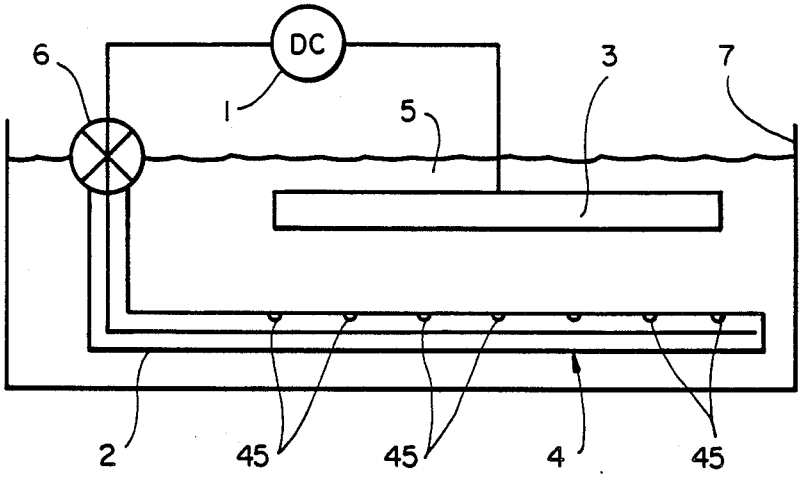
FIGS. 1–4 illustrates various embodiments of the invention.

The barrier which is used in the present invention modifies the way in which current flows between the substrate and the anode so as to produce one or more of the desirable results noted above. In general, this will result in the resistance between the substrate and the anode being substantially higher than it would be in the absence of the barrier, preferably by a factor of at least 10, for example at least 100, or even more, balancing the resulting advantages against the disadvantage of the higher voltages requires as the resistance increases.

The barrier preferably comprises a plurality of ion-permeable sections. Preferred ion-permeable sections include simple apertures, for example a hole in the wall of a tube, or an opening at the end of a tube. Ion-permeable sections which are composed of an ion-permeable material, e.g. a glass frit, can also be used, especially when it is desired to have the anode contacted by an electrolyte which is different from that which contacts the substrate. The size and/or the spacing of the ion-permeable sections can be uniform or non-uniform, depending upon the desired current distribution on the substrate. The ion-permeable sections are preferably of fixed dimensions. The distance between adjacent ion-permeable sections is preferably less than 10 times, particularly less than 4 times, the distance between the ion-permeable sections and the substrate. An important factor in determining the size of the apertures can be the need to ensure that anodic reaction products, e.g. gaseous chlorine, do not block the apertures. Unless the conditions of operation are such that anodic reaction products remain dissolved in the electrolyte or can be easily vented, care must be taken to prevent harmful build-up of such reaction products between the anode and the barrier. In some case positive benefit can be derived from such reaction products, e.g. to lessen fouling of marine structures. To assist in the dispersion of such reaction products, it is preferred to operate the system in such a way that hydrostatic pressure drives the electrolyte through the ion-permeable section(s) towards the substrate. Such hydrostatic pressure, which is typically provided by a pump, can have the alternative and/or additional advantages of (1) reducing the danger that the ion-permeable sections will be blocked by contaminants present in the electrolyte between the barrier and the substrate, for example oily contaminants in the water layer at the bottom of an oil storage tank, and/or (2) making it possible, when it is desired to surround the anode with an electrolyte which is different from the electrolyte which contacts the substrate (e.g. when protecting a potable water tank with a platinum anode), to prevent substantial contamination of the anode electrolyte by the substrate electrolyte with minimal contamination of the substrate electrolyte by the anode electrolyte.

The barrier must not be electronically connected to the substrate or the anode, and is preferably composed of (including coated by) an electrically insulating material, e.g. a plastic. Preferred barriers are in the form of a tube (which may be of round or other cross section) or a plurality of tubes which are joined together to form a branched structure. In such a branched structure, the branch tubes are preferably of smaller cross-section than the main tube, for example so that the total cross-sectional area of the branch tubes is no greater than the cross-sectional area of the main tube. The tube or tubes can be heated by an internal or external heater to reduce the viscosity of the electrolyte therein (including to prevent it from freezing) and/or to reduce its resistivity. The tube or tubes can be arranged as a continuous loop, so that electrolyte circulates through them, or can simply terminate in an open end (i.e. an ion-permeable section) or a closed end.

In a particularly preferred embodiment, the tube (or at least one of the tubes where a plurality of tubes are joined together) surrounds an elongate anode, for example one whose length is at least 100 times, e.g. at least 1000 times, its smallest dimension, typically a metal wire, especially a platinum or platinum-coated wire, having for example a diameter of at least 0.01 inch, preferably 0.02 to 0.3 inch. The internal diameter of the tube containing the wire anode is preferably P times the diameter of the wire, where P is 2 to 100, e.g. 5 to 30, for example a diameter of 0.125 to 0.6. The tube containing the wire anode comprises ion-permeable sections, or there are branch tubes comprising ion-permeable sections attached thereto, or both. The branch tubes can comprise perforations and/or can have an open end, which may be fitted with a nozzle. In this way, it is possible to obtain a much more uniform current density on the anode, and hence also on the substrate, than in the absence of the barrier. This desirable result is achieved because the resistance between the substrate and the elongate anode is much greater than it would be in the absence of the tube or tubes, preferably by a factor of at least 10, for example at least 100 or even higher. This is especially valuable when it is desirable to provide a high current from a distributed anode. Under these circumstances, it is not satisfactory to use an anode comprising a metal core and a conductive polymer jacket, because such anodes cannot support the high current densities required. Nor is it satisfactory to use a platinum wire anode (or the like); such anodes will support very high current densities, but at the currents needed in such circumstances, the current density on the anode decreases rapidly as the distance from the power source increases, as demonstrated for example in Example 2 below.

In another preferred embodiment, the anode is a discrete electrode which is placed in a vessel remote from the substrate, and electrolyte is pumped (or gravity fed) from the anode vessel to the vicinity of the substrate via one or more tubes which constitute the barrier and which contain (including terminate in) ion-permeable sections. In such a system, it is important that the resistance of the electrolyte in the tube or tubes should not be too high. Therefore, the resistivity of the electrolyte is preferably less than 50 ohm.cm, particularly less than 20 ohm.cm, so that the tubes can be of a convenient size. In this embodiment, the main tube or tubes conveying electrolyte from the anode chamber to the vicinity of the substrate may for example have an equivalent inner diameter (i.e. of cross-section equal to a circle of that diameter) of 1 to 12 inches, and the branch tubes may for example have an equivalent diameter of 0.5 to 3 inches.

Any appropriate DC power source can be used in the present invention. The voltage of the power source is preferably less than 100 volts, particularly less than 50 volts, and the system designed with this preference in mind.

When there is a net transfer of electrolyte through the ion-permeable section(s) of the barrier, electrolyte must be supplied to the anode, and this can be done by recycling electrolyte from the vicinity of the substrate and/or by supplying fresh electrolyte. When build-up of electrolyte in the vicinity of the substrate must be avoided, e.g. in the bottom of an oil storage tank, means must be provided for removing excess electrolyte; the excess electrolyte can be recycled to the anode, if desired or necessary after filtering or otherwise treating it to remove harmful contaminants.

Preferred uses for the present invention include the protection of city water tanks, ballast tanks in ships, oil rigs, cooling tanks for power stations, water tanks for secondary recovery in oil wells, oil storage tanks, heat exchangers, condensers, heater treaters, and buried pipes, in particular pipes buried below the permafrost line, for example oil pipes in frozen tundra.

Figure 2:
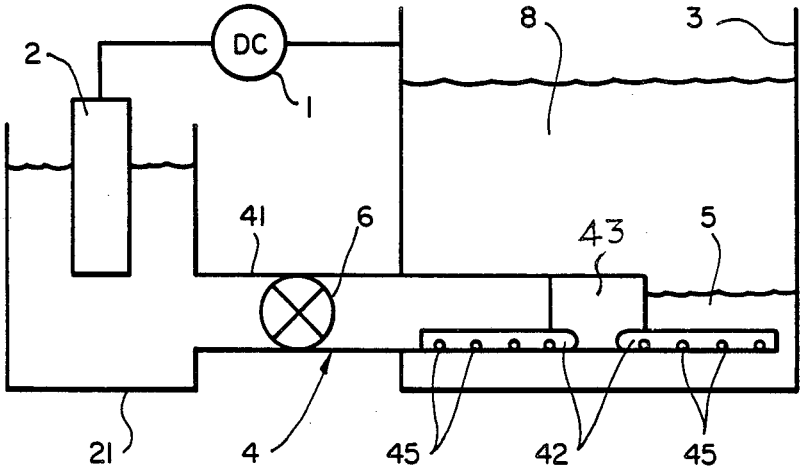

Referring now to the drawing, each of FIGS. 1 and 2 shows a DC power source 1 which is connected to an anode 2 and a corrodible substrate 3 which is a cathode. Anode 2 and substrate 3 are separated by a barrier 4 which comprises ion-permeable sections 45, and are connected by electrolyte 5 through sections 45. A positive hydrostatic pressure is maintained from the interior of the barrier 4 across the ion-permeable sections 45 by means of pump 6.

FIG. 1 is a diagrammatic side view which shows the corrodible substrate 3 within a vessel 7 containing the electrolyte 5. The anode 2 is an elongate anode, and the barrier 4 is a perforated tube containing the anode.

FIG. 2 is a diagrammatic cross-sectional side view in which the substrate 3 is an oil storage tank in which the electrolyte 5 is a highly corrosive aqueous mixture covered by oil 8. The anode is a discrete anode which lies within an anode chamber 21. The barrier 4 comprises, in addition to the part of the anode chamber which lies between the anode and the tank 3, a tube 41 which leads from anode chamber 21 to the center of tank 3 and branch-tubes 42 which communicate with tube 41 via a central chamber 43, which are of relatively small diameter, and which contain perforations 45. Means not shown removes excess electrolyte from the tank 5. Pump 6 maintains a positive pressure across the perforations 45 and thus reduces the danger that they will become blocked by oily contaminants in the water layer.

Figure 3:
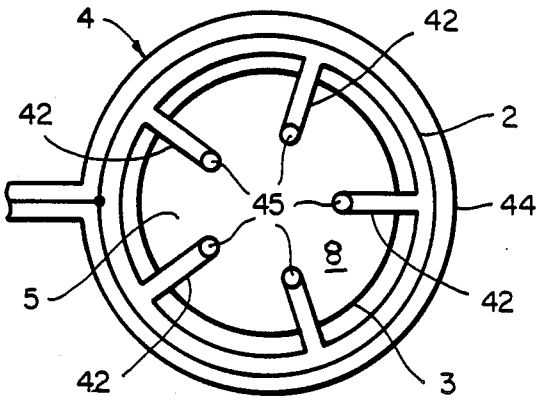

FIG. 3 shows in diagrammatic plan view an alternative way of protecting a vessel 3 containing an electrolyte 8. Tube 44 surrounds the vessel and contains elongate anode 2. Branch tubes 42 communicate with tube 44, pass through the wall of the vessel, and terminate in open ends or nozzles 45 which can point in one or more desired directions within the electrolyte 8.

Figure 4:
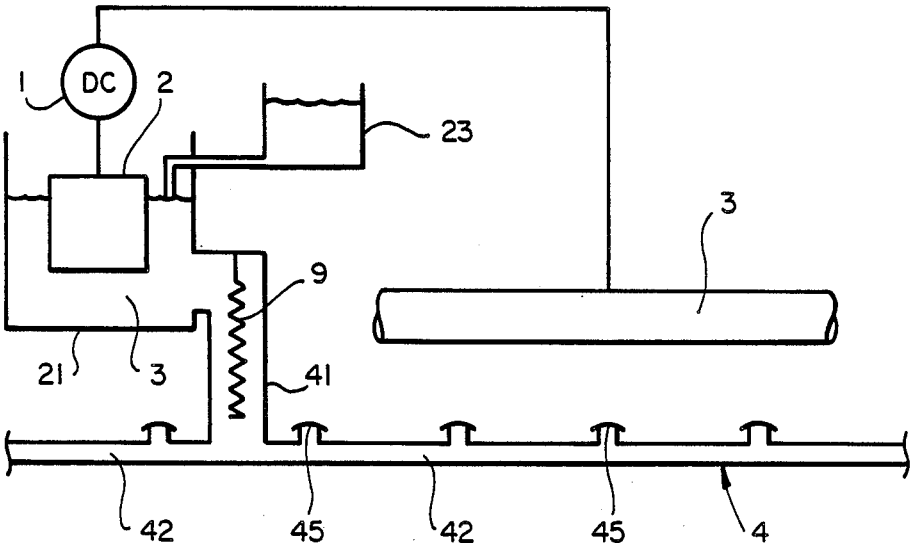

FIG. 4 shows in diagrammatic side view a system for protecting a pipe 3 which is buried in the earth or immersed in the sea or other electrolyte. The anode 2 lies within an anode chamber 22 and is surrounded by electrolyte 3. Barrier 4 comprises a tube 41 which extends downwards from the anode chamber 21 and branch tubes 42 which communicate with and extend horizontally from the tube 41 under the pipe 3, and which comprise nozzles 45 covered by protective caps. Tube 41 contains a heater 9 which may be used to prevent the electrolyte from freezing or reduce its viscosity, for example when the tube 41 passes through a layer of earth which is frozen or liable to freezing, and/or to decrease its resistivity. A positive hydrostatic pressure is maintained across the nozzles 45, and the electrolyte lost in consequence is replaced from electrolyte storage tank 23.

Figure 5:
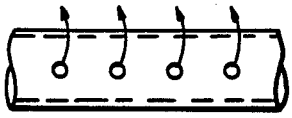
FIGS. 5–11 illustrate various ways in which ion-permeable sections can be provided in the barrier used in the invention.
Figure 6:
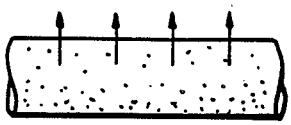
Figure 7:
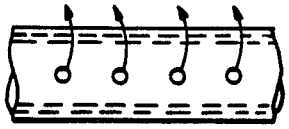
Figure 8:
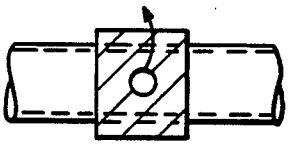
Figure 9:
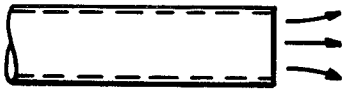
Figure 10:
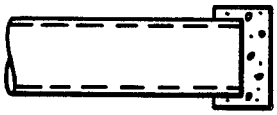
Figure 11:
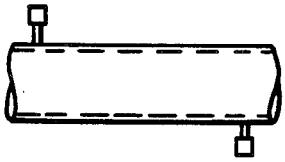
Figure 12:
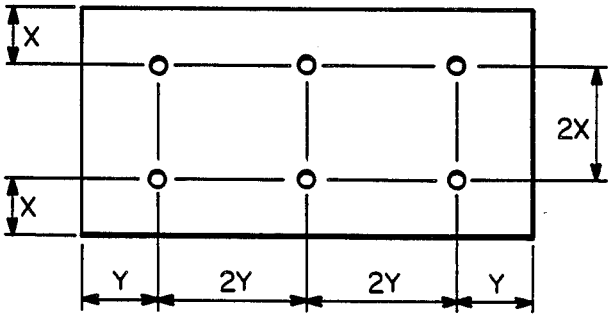
FIG. 12 illustrates part of the apparatus used in Example 1.

FIG. 5 shows a tube with perforations therein through which ion-containing electrolyte can emerge; the perforations shown are uniformly spaced and of uniform size, but they could be of different sizes and separations in order to provide desired current distribution. FIG. 6 shows a tube composed of an ion-conducting membrane through which ions can pass, but non-ionic material cannot. FIG. 7 shows a perforated tube which is covered by an ion-conducting membrane. FIG. 8 shows a part of a perforated tube in which each perforation is covered by an ion-conducting membrane. FIG. 9 shows an open-ended tube through the open end of which ion-containing electrolyte can emerge. FIG. 10 shows an open-ended tube whose open end is covered by a porous plug. FIG. 11 shows a tube having a plurality of branch nozzles mounted thereon. FIG. 12 shows the arrangement of the tube in Example 1, as described below.

The invention is illustrated in the following Examples.

EXAMPLE 1

In this Example, procedures (A) and (B) are comparative Examples, and procedure (C) is an example of the invention.

(A) An 18×24 inch (45.7×61.0 cm) stainless steel mesh screen was placed on the bottom of a tank. One end of each of six flexible plastic tubes 0.375 inch (0.95 cm) inner diameter×6 foot (182.9 cm) long was positioned about 1 inch (2.5 cm) from the screen; the ends of the tubes were placed in a rectangular pattern centered over the screen as illustrated in FIG. 12, with x being 4.5 inch and y being 4 inch. The other end of each tube was placed in a second tank adjacent the first. The tubes and both tanks were filled with 3% NaCl solution having a resistivity of about 20 ohm.cm. A saturated calomel electrode (SCE) was placed in the first tank in a number of different positions so that the potential of different parts of the screen could be measured. The corrosion potential of the screen was measured to be 0.220 V, and was uniform across the screen surface.

(B) The apparatus described in (A) was modified by placing a single graphite anode 1 inch (2.5 cm) above in the center of the screen. The anode and the screen were connected to a DC power source of sufficient voltage to maintain a total current of 0.05A. The absolute potential of the screen (i.e. the potential measured by the SCE minus the corrosion potential) was found to be at a maximum of 0.560 V. The absolute potential decreased in a radial pattern away from the anode, reaching 0.499 V at the edge of the screen, a total difference of 0.061 V.

(C) The apparatus described in (A) was modified by placing a single graphite anode in the second tank. The anode and the screen were connected to a DC power source, and with the tubes acting as salt bridges between the tanks, sufficient voltage (about 45 VDC) was applied to maintain a total current of 0.05 VA. The absolute potential of the screen was found to be at a maximum of 0.550–0.563 V directly below each of the tube openings and at a minimum of 0.540 V at the edges of the screen, i.e. a difference of at most 0.023 V as compared to a difference of at most 0.061 V in (B) above.

EXAMPLE 2

In this Example, procedures (A) and (B) are comparative examples and procedure (C) is an example of the invention.

(A) A plastic trough about 18 feet (5.5 m) long and of semi-circular cross-section, diameter 4 inch (10.2 cm), was connected by means of a drain to a plastic tank containing a submersible pump. The trough, the tank and the drain were filled with aqueous potassium chloride electrolyte of resistivity 20.5 ohm.cm. A mild steel rod about 18 feet (5.5 m) long and 0.5 inch (1.25 cm) in diameter was placed in the bottom of the trough. A plastic tube about 18 feet (5.5 m) long, 0.375 inch (0.95 cm) in inner diameter and 0.5 inch (1.25 cm) in outer diameter was secured to the wall of the trough, parallel to the mild steel rod and spaced apart from it. The plastic tube comprised holes 0.010 inch (0.025 cm) in diameter every 3.94 inch (10 cm) along a straight line, and the tube was secured to the trough so that the holes were 0.75 to 1 inch (1.9–2.5 cm) from the mild steel rod. One end of the tube was connected to the submersible pump in the tank and the other end was sealed. The pump was used to pump electrolyte through the tube. Excess electrolyte returned from the trough to the tank through the drain. A saturated calomel reference electrode (SCE) was placed in the trough in a number of different positions so that the potential of different parts of the rod could be measured. The corrosion potential of the rod was measured to be between 0.626 and 0.699 V, an average of 0.655 V.

(B) The apparatus described in (A) was modified by securing a platinum wire anode 0.010 inch (0.025 cm) in diameter and about 18 foot (5.49 m) long to the surface of the plastic tube so that the anode was 0.75 to 1 inch (1.9 to 2.5 cm) from the rod. The rod and one end of the anode were connected to a DC power source of sufficient voltage to maintain a current of 0.5 amp. The absolute potential of the rod (i.e. the potential measured by the SCE minus the corrosion potential) was found to be 0.62 V at the end which is adjacent the end of the anode connected to the power source, and to decrease to 0.05 V at the other end, a total difference of 0.57 V.

(C) The apparatus described in (B) was modified by placing the anode inside the plastic tube. The power source was adjusted to provide a current of 0.5 amp, and the pump was adjusted to provide a flow rate which ensured that the holes in the tube were not plugged by the gaseous products evolved at the anode (i.e. chlorine and oxygen). The absolute potential of the rod was found to be between 0.40 and 0.55 V, i.e. a total difference of 0.15 V.

We claim:

1. An assembly for cathodically protecting an electrically conductive substrate from corrosion, the assembly comprising (1) an electrically conductive substrate which is liable to corrosion;

(2) an elongate distributed anode which has a shape corresponding generally to the shape of the substrate and which is relatively close to all points on the substrate; and (3) a barrier which (i) lies between the substrate and the anode, (ii) is spaced apart from the substrate and from the anode, and (iii) is in the form of a tube which surrounds the anode and has a plurality of ion-permeable sections therein such that, when the anode and the substrate are electrically connected to opposite poles of a DC power source and are electrically connected by means of an electrolyte, the barrier restricts the flow of current between the substrate and the anode so that the resistance between the substrate and the anode is Q times the resistance between them in the absence of barrier, where Q is at least 1.5; and (4) a pump for pumping liquid electrolyte down the tube and through the ion-permeable sections towards the substrate.

2. An assembly according to claim 1 wherein Q is at least 10.

3. An assembly according to claim 1 wherein Q is at least 100.

4. An assembly according to claim 1 wherein the substrate and the anode are connected to opposite poles of a DC power source of voltage less than 100 volts.

5. An assembly according to claim 1 wherein the barrier is composed of an insulating material.

6. An assembly according to claim 5 wherein the anode is a metal wire and the internal diameter of the tube is P times the diameter of the wire, where P is 2 to 100.

7. An assembly according to claim 6 wherein the wire has a platinum surface.

8. An assembly according to claim 7 wherein the diameter of the wire is 0.02 to 0.3 inch.

9. An assembly according to claim 8 wherein P is 5 to 30.

10. An assembly according to claim 1 wherein the ion-permeable sections are apertures in the wall of the tube.

11. An assembly according to claim 1 wherein the barrier further comprises a plurality of branch tubes, each of the branch tubes communicating with the tube and having at least one aperture therein.

12. An assembly according to claim 1 wherein the length of the anode is at least 100 times its smallest dimension.

13. An assembly according to claim 12 wherein the length of the anode is at least 1000 times its smallest dimension.

14. An assembly according to claim 1 wherein the ion-permeable sections are of fixed dimensions.

15. A method of cathodically protecting an electrically conductive substrate from corrosion by a liquid electrolyte which contacts it, which method comprises establishing a potential difference between the substrate as cathode and an elongate distributed anode which has a shape corresponding generally to the shape of the substrate and which is relatively close to all points on the substrate, and in which method current flows between the substrate and the anode along current paths which pass through ion-permeable sections of a barrier which (i) lies between the substrate and the anode, (ii) is spaced apart from the substrate and the anode, and (iii) is in the form of a tube which surrounds the anode and has a plurality of ion-permeable sections therein, and in which method a pump drives an electrolyte down the tube and through the ion-permeable sections towards the substrate.

16. A method according to claim 12, wherein the barrier further comprises a plurality branch tubes, each of the branch tubes communicating with the tube and having at least one aperture therein.

17. A method according to claim 15 wherein the anode is a wire having a platinum surface.

18. A method according to claim 15 wherein the resistance between the substrate and the anode is Q times the resistance between them in the absence of the barrier, where Q is at least 10.

19. A method according to claim 18 wherein Q is at least 100.

* * * * *

UNITED STATES PATENT AND TRADEMARK OFFICE

CERTIFICATE OF CORRECTION

PATENT NO. : 4,874,487

DATED : October 17, 1989

INVENTOR(S) : James P. Reed

It is certified that error appears in the above-identified patent and that said Letters Patent is hereby corrected as shown below:

In Claim 16, line 1, replace "claim 12" by --claim 15--.

Signed and Sealed this

Twenty-eighth Day of May, 1991

*Attest:*

HARRY F. MANBECK, JR.

*Attesting Officer*

*Commissioner of Patents and Trademarks*